US005730609A

United States Patent [19]

Harwath

[11] Patent Number: 5,730,609

[45] Date of Patent: Mar. 24, 1998

[54] HIGH PERFORMANCE CARD EDGE CONNECTOR

[75] Inventor: Frank A. Harwath, Downers Grove, Ill.

[73] Assignee: Molex Incorporated, Lisle, Ill.

[21] Appl. No.: 758,601

[22] Filed: Nov. 27, 1996

Related U.S. Application Data

[62] Division of Ser. No. 430,952, Apr. 28, 1995, Pat. No. 5,580,257.

[51] Int. Cl.[6] ..... H01R 13/652

[52] U.S. Cl. ..... 439/108; 439/607; 439/608; 439/637

[58] Field of Search ..... 439/101, 108, 439/608, 636, 637, 607

[56] References Cited

U.S. PATENT DOCUMENTS

| | | | |
|---|---|---|---|
| 3,399,372 | 8/1968 | Uberbacher . | |
| 4,298,237 | 11/1981 | Griffith et al. | 449/637 |
| 4,456,317 | 6/1984 | McCleerey | 439/607 |
| 4,806,109 | 2/1989 | Manabe et al. | 439/607 |
| 4,950,172 | 8/1990 | Anhalt et al. | 439/108 |
| 4,973,260 | 11/1990 | Madore et al. | 439/101 |
| 5,024,609 | 6/1991 | Piorunneck | 439/637 |
| 5,026,292 | 6/1991 | Pickles et al. | 439/108 |
| 5,035,631 | 7/1991 | Piorunneck et al. | 439/108 |
| 5,035,632 | 7/1991 | Rudoy et al. | 439/108 |
| 5,051,099 | 9/1991 | Pickles et al. | 439/108 |
| 5,071,371 | 12/1991 | Harwath et al. | 439/637 |
| 5,096,435 | 3/1992 | Noschese et al. | 439/260 |
| 5,098,306 | 3/1992 | Noschese et al. | 439/637 |
| 5,156,554 | 10/1992 | Rudoy et al. | 439/108 |
| 5,184,965 | 2/1993 | Myschik et al. | 439/607 |
| 5,228,871 | 7/1993 | Goodman | 439/607 |
| 5,259,768 | 11/1993 | Brunker et al. | 439/60 |

*Primary Examiner*—Gary F. Paumen
*Attorney, Agent, or Firm*—Charles S. Cohen

[57] ABSTRACT

A high performance card edge connector includes a housing with an elongated printed circuit card receiving slot in a top wall. Terminals are mounted in transverse cavities intersected by the slot. Alternate cavity portions receive a pair of signal terminals and interspersed alternate cavity portions receive single ground terminals. Each terminal includes a downwardly extending board contact portion for connection to a printed circuit board and a card contact portion in the slot for engagement with a contact pad of an inserted card. Each signal terminal pair is flanked two ground terminals on the same side of the slot and is transversely opposite a ground terminal on the opposite side of the slot. A uniform identical cavity configuration permits each cavity portion to receive either a ground terminal or a pair of signal terminals.

3 Claims, 2 Drawing Sheets

HIGH PERFORMANCE CARD EDGE CONNECTOR

This is a divisional of application Ser. No. 08/430,952 filed on Apr. 28, 1995, now U.S. Pat. No. 5,580,257 issued on Dec. 3, 1996.

FIELD OF THE INVENTION

The present invention relates to electrical connectors for printed circuits and more particularly to a high density, low impedance card edge connector useful in high frequency circuits.

DESCRIPTION OF THE PRIOR ART

Card edge connectors are widely used for connecting printed circuit cards, called daughtercards, to printed circuit boards or motherboards. A typical card edge connector includes an insulating housing with a card edge receiving slot and numerous cavities receiving electrical terminals. The terminals include board contacts extending downward from the housing and card contacts that engage conductive pads on the edge of a card inserted into the slot. The housing is mounted on the motherboard with the board contacts soldered to conductive regions of the motherboard. The card edge connector removably receives the daughtercard and the terminals provide conductive paths between conductive pads on the card and conductive regions of the board.

In order to achieve improved performance, faster operating speeds and increased circuit density are important trends in digital electronic circuits using printed circuits. For example, microprocessors operate at ever increasing frequencies and communicate with ancillary devices such as memory, display drivers and the like over wide channels with increasing numbers of parallel connections. These trends result in problems in the design of connectors used with such circuits.

The goal of high circuit density may be met with closely spaced terminals having relatively small cross sectional areas. The requirement for high frequency operation results in the need for low impedance in order to accommodate fast digital pulse rise times and wide bandwidth. But close circuit spacing can result in increased crosstalk due to capacitive coupling and can result in increased impedance due to long and/or narrow signal paths. In addition, at high frequencies, shielding from external interference may be desirable. Known card edge connector designs have not been entirely effective in meeting these several and sometimes conflicting goals without high cost and undesirable complexity.

SUMMARY OF THE INVENTION

A principal object of the present invention is to provide an improved high performance card edge connector. Other and more specific objects are to provide a connector with high circuit density and low impedance; to provide a connector suitable for use with high frequency digital signals; to provide a connector in which crosstalk is minimized; to provide a connector having interference shielding characteristics; and to provide an improved connector overcoming disadvantages of card edge connectors used in the past.

In brief, in accordance with the present invention there is provided a card edge connector for a removable printed circuit card having a mating edge with a plurality of conductive pads. The connector includes an insulating housing with elongated top and bottom walls and elongated spaced apart side walls. A plurality of transverse cavities extend between the side walls. An elongated slot in the top wall receives the mating edge of the circuit card. The slot intersects the cavities and divides them into similar, aligned cavity portions at opposite sides of the slot. A plurality of ground and signal terminals are received in the cavity portions, and each of the terminals includes a mounting portion for holding the terminal in one of the cavity portions and a contact portion for engaging one of the contact pads upon insertion of the mating edge into the slot. The card edge connector is characterized by a single one of the ground terminals being disposed in each of a group of spaced apart first cavity portions, and a plurality of the signal terminals being disposed in each of a group of second cavity portions, each of the second cavity portions being adjacent one of the first cavity portions.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
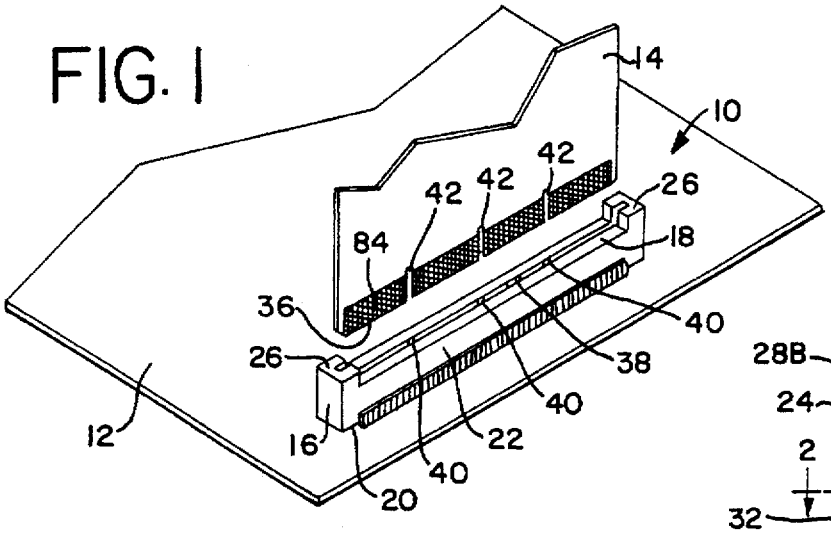
FIG. 1 is an isometric view of a high performance card edge connector constructed in accordance with the present invention used for interconnecting a printed circuit motherboard and a printed circuit daughtercard.

Having reference now to the drawings, FIG. 1 illustrates a card edge connector 10 constructed in accordance with the principles of the present invention together with a printed circuit motherboard 12 and a printed circuit daughtercard 14. In a typical application for example, the board 12 may be a motherboard of a computer or other electronic device incorporating digital electronics, and card 14 may be a smaller printed circuit board or daughterboard having electronic devices such as memory or the like. Connector 10 is mounted on the board 12 and the card 14 is releasably inserted into the connector 10 in order to establish electrical connections between the board 12 and card 14.

The structure of the connector 10 is seen in FIGS. 1–4. It includes an insulating housing 16 formed of molded plastic including an elongated top wall 18, a bottom surface 20, and elongated, opposed side walls 22 and 24. The ends of the housing 16 are provided with raised guide portions 26. The housing may be provided with standoffs and mounting pegs (not shown) extending down from the bottom wall 20 to hold the housing 16 on the board 12 until it is permanently attached in a soldering operation with bottom wall 20 parallel to the board surface. These features are disclosed for example in U.S. Pat. No. 5,259,768 incorporated herein by reference.

An array of numerous terminal receiving cavities 28 extend transversely between the side walls 22 and 24. The cavities are separated by barrier walls 30 of the housing 16. The upper portions of the cavities 28 are closed by the top wall 18 and the lower portions of the cavities open through the bottom surface 20. The housing 16 includes an elongated, central internal mounting rail 32. Terminal spacer projections 34 extend outwardly from the side walls 22 near the bottom of the housing 16.

The daughtercard 14 includes a mating edge 36. The housing 16 includes an elongated slot 38 formed along the center of the top wall 18 for receiving the mating edge 36. The guide portions 26 aid in inserting the mating edge 36 into the slot 38. The housing 16 includes keys or transverse webs 40 extending across the slot 38 and received in keyways or channels 42 in the mating edge 36 to provide a positioning or keying function. The slot 38 intersects the cavities 28 and the walls 30, and the cavities are divided into opposed, transversely aligned cavity portions 28A and 28B on opposite sides of the slot 38. All of the cavities 28 are identical to one another, and all of the portions 28A and 28B are also identical except for orientation with respect to the slot 38. A bottom wall 39 of the slot 38 is defined by portions of the barrier walls 30.

Electrical connections are made between the motherboard 12 and the daughtercard 14 by signal terminals 44 and 46 and by ground terminals 48 received in the cavities 28. The terminals 44, 46 and 48 are formed from conductive sheet metal, for example by blanking, stamping and forming, and in the illustrated arrangement are loaded into the cavities 28 through the bottom surface 20.

Each ground terminal 48 includes a base portion 50 that generally coincides with bottom surface 20 when the terminal is in place. A board contact or tail portion 52 extends down from the base portion 50 for connection to a conductive region of the board 12. A large area panel portion 54 extends up from the base portion 50, and a flexible resilient spring arm portion 56 extends from the panel portion 54. The spring arm portion 56 terminates in a card contact portion 58 that is located within the slot 38 in the path of an inserted mating edge 36 of card 14. A mounting portion or arm 60 secures the ground terminal 48 in place by frictionally receiving the side wall 22 or 24 between the arm 60 and the panel portion 54. Arm 60 is received between a pair of the lugs 34.

Each "inner" signal terminal 44 includes a base portion 62 that generally coincides with bottom surface 20 when the terminal is in place. A board contact or tail portion 64 extends down from the base portion 62 for connection to a conductive region of the board 12. A flexible resilient spring arm portion 66 extends from the base portion 62. The spring arm portion 66 terminates in a card contact portion 68 that is located within the slot 38 in the path of the inserted mating edge 38 of card 14. A mounting portion or finger 70 is frictionally received in an aperture in the rail 32 in order to secure the signal terminal 44 in place.

Each "outer" signal terminal 46 includes a base portion 72 that generally coincides with bottom surface 20 when the terminal is in place. A board contact or tail portion 74 extends down from the base portion 50 for connection to a conductive region of the board 12. A leg portion 76 extends up from the base portion 72, and a flexible resilient spring arm portion 78 extends from the leg portion 76. The spring arm portion 78 terminates in a card contact portion 80 that is located within the slot 38 in the path of an inserted mating edge 36 of card 14. A mounting portion or arm 82 secures the signal terminal 46 in place by frictionally receiving the side wall 22 or 24 between the arm 82 and the leg portion 76. Arm 82 is received between a pair of the lugs 34.

Figure 3:
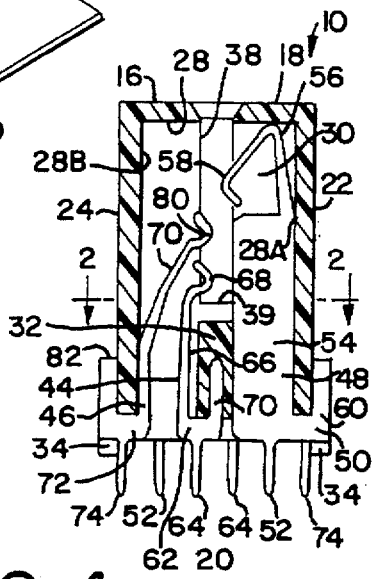
FIG. 3 is a sectional view of the connector taken along the line 3—3 of FIG. 2.
Figure 4:
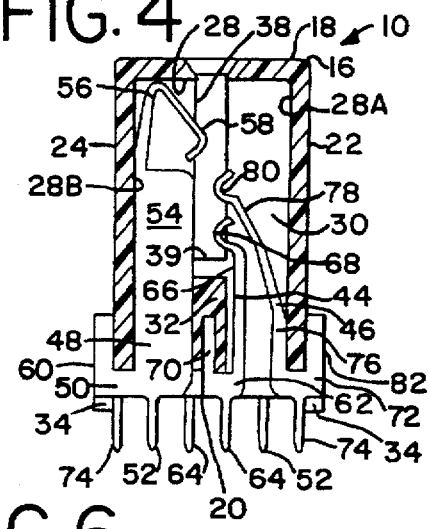
FIG. 4 is a sectional view of the connector taken along the line 4—4 of FIG. 2.

High contact density is achieved with the connector 10 by mounting more than a single signal contact in the cavity portions 28A or 28B. As seen in FIGS. 3 and 4, a signal contact 44 and a signal contact 46 are mounted side by side in a single cavity portion. The terminals 44 and 46 are electrically independent from one another because they are spaced apart and not in contact with one another. As a result, two independent electrical signals may be conducted through a single cavity portion 28A or 28B.

Figure 2:
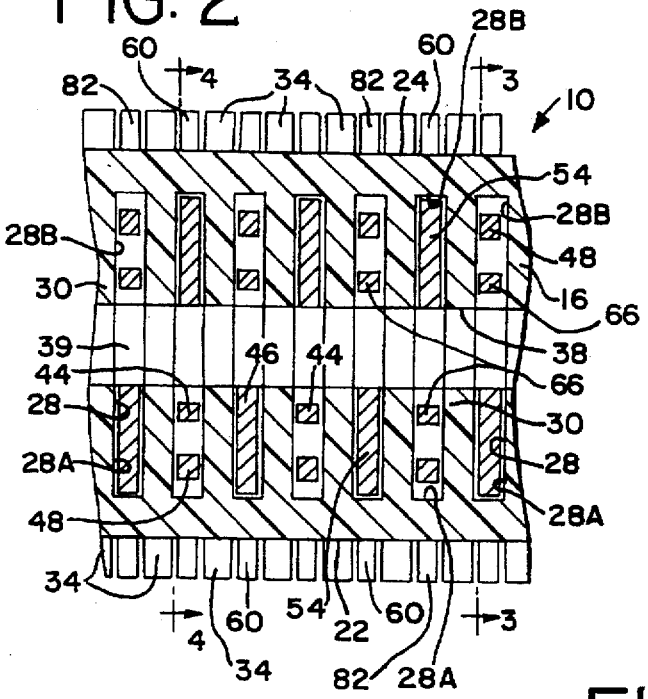
FIG. 2 is an enlarged fragmentary horizontal sectional view of the connector taken along the line 2—2 of FIG. 3.

Impedance control, signal isolation and crosstalk reduction are achieved by interspersing the ground terminals 48 among the signal terminals 44 and 46. Every other cavity portion 28A and every other cavity portion 28B is provided with a ground terminal 48. The remaining alternate cavity portions 28A and 28B are each provided with a pair of signal terminals 44 and 46. On both sides of the slot 38 there is a pattern of alternating ground and signal terminals. A part of this continuing pattern is seen in FIG. 2. Preferably the patterns are offset on opposed sides of the slot 38 so that in each cavity 28 a pair of signal terminals 44 and 46 are directly opposite a single ground terminal 48.

Within the pattern of terminals of the connector 10, each signal terminal pair 44, 46 is sandwiched between a flanking pair of ground terminals 48 and is also aligned with an opposed ground terminal 48 on the opposite side of the slot 38. This geometry provides some of the advantages of a coaxial transmission path where a signal conductor is surrounded by a ground conductor, but with significantly greater density and significantly lower material and assembly costs.

One factor in limiting the cost of the connector 10 is the modularity of the design. Each identical cavity portion 28A or 28B of each identical cavity 28 can accommodate either a single ground terminal 48 or a pair of signal terminals 44 and 46 without any modification of the housing structure. All of the signal terminals 44 are disposed near the longitudinal center of the housing 16 and can be mounted on either side of the slot 38 in either a cavity portion 28A or a cavity portion 28B by insertion of the finger portion 70 into the central mounting rail 32. Either a signal terminal 46 or a ground terminal 48 can be mounted in any cavity portion 28A or 28B by engagement of the arm portion 60 or the arm portion 82 with a side wall 22 or 24.

The ground terminals 48 and signal terminals 44 and 46 are configured to reduce crosstalk by creating preferential couplets between the signal terminals 44 and 46 and the ground terminals 48 rather than directly between signal terminals 44 and 46. As seen in FIGS. 3 and 4, the large area, continuous panel portions 54 of the ground terminals 48 have peripheries or silhouettes that surround or overlie the spring arm portions 66 of signal terminals 44 as well as the leg portions 76 and the spring arm portions 78 of the signal terminals 46. Base portions 50 also overlie base portions 62 and 72.

Substantially the entire signal current paths through the signal terminals 44 and. 46 are aligned between large area portions of the immediately adjacent ground terminals 48. The relatively large area and mass of the ground terminals 48 achieves a ground plane effect and reduced ground inductance. In addition, the ground terminals 48 are separated from the pairs of signal terminals 44 and 46 by barrier walls 30. These walls are part of the housing 16 and are a molded, dielectric plastic material. In contrast the terminals 44 and 46 of each pair of signal terminals are separated by air. The dielectric housing material increases the coupling of each signal terminal 44 and 46 to the adjacent ground terminal, while the air separation between signal terminals minimizes the cross coupling between signal terminals 44 and 46.

Card contact portions 68 of the signal terminals 44 are arranged in two lines at opposite sides of the slot 38 and parallel to the bottom wall 20. These lines are equidistant from the bottom wall 20 and are relatively close to the bottom 39 of the slot 38. Card contact portions 80 of the signal terminals 46 are also arranged in two lines at opposite sides of the slot 38 and parallel to the bottom wall 20. These lines are equidistant from the bottom wall 20 and are located above the lines of card contact portions 68. Card contact portions 58 of the ground terminals 46 are also arranged in two lines at opposite sides of the slot 38 and parallel to the bottom wall 20. These lines are equidistant from the bottom wall 20 and are located above the lines of card contact portions 68 and 80.

The ground terminals 48 provide an interference shielding effect because the ground card contact portions 58 are more elevated than the signal card contact portions 68 and 80. The ground paths are arrayed like a canopy or umbrella around the signal current paths and act to shield the signal current paths from electromagnetic interference.

The card contact portions of the terminals 44, 46 and 48 are arrayed in a high density configuration. The card contact portions 68 and 80 of each pair of signal terminals 44 and 46 are vertically spaced apart and are aligned in the same vertical plane. The card contact portion 58 of the transversely opposed ground terminal 48 lies in the same vertical plane. The card contact portions 58 of the two flanking ground terminals 48 are longitudinally spaced from this vertical plane by a distance equal to the pitch of the terminals within the housing 10, i.e. the distance between centerlines of cavities 28.

Figure 5:
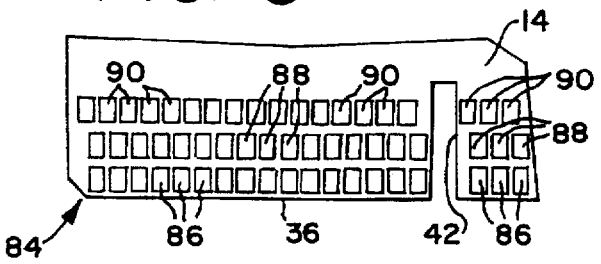
FIG. 5 is a fragmentary enlarged elevational view of part of the daughtercard of FIG. 1.

As seen in FIG. 5, the card 14 includes a contact pad array 84 configured to mate with the card contact portions 58, 68 and 80. A first line of signal contact pads 86 lies along the mating edge 36. Pads 86 are contacted by the card contact portions 68 of signal terminals 44 when the card 14 is inserted into slot 38. A second line of signal contact pads 88 lies above pads 86. Pads 88 are contacted by the card contact portions 80 of signal terminals 44 when the card 14 is inserted into slot 38. A third line of ground contact pads 90 lies above pads 86 and 88. Pads 90 are contacted by the card contact portions 58 of ground terminals 48 when the card 14 is inserted into slot 38. One of the two surfaces of the card 14 is seen in FIG. 5. The opposite side is similar except that the pads are displaced longitudinally by a distance equal to the connector pitch with signal pads 86 and 88 on one surface of the card aligned with a ground pad 90 on the opposite surface.

The board contact or tail portions 52, 64 and 74 of the terminals 48, 44 and 46 are arrayed to maximize circuit density not only within the connector 10 but also at the interface with the motherboard 10. The board contact portions 74 of signal terminals 46 are in two parallel longitudinal lines at the opposite sides of the housing 16. The board contact portions 64 of signal terminals 48 are in two parallel longitudinal lines located near the center of the housing 16. The board contact portions 52 of the ground terminals 48 are in two parallel lines between the board contact portions 74 and 64. The lines of the board contact portions are equally spaced apart across the width of the connector 10, and preferably the spacing is equal to the connector pitch.

Figure 6:
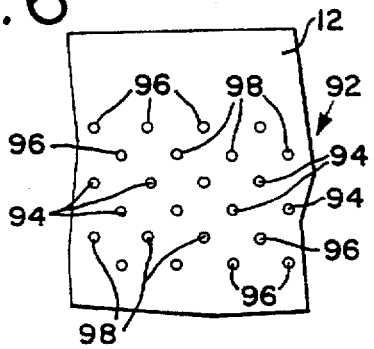
FIG. 6 is a fragmentary enlarged plan view of part of the motherboard of FIG. 1.

A matching array 92 of conductive regions on the board 12 is seen in FIG. 6. Central lines of conductive regions 94 are engaged by board contact portions 64 of signal terminals 44. Outer lines of conductive regions 96 are engaged by board contact portions 74 of signal terminals 46. Intermediate lines of conductive regions 98 are engaged by board contact portions 52 of ground terminal 48. The uniform transverse spacing equal to the connector pitch produces the uniformly staggered array 92 seen in FIG. 6 and permits high signal density.

In the illustrated arrangement, the conductive regions 94, 96 and 98 are plated-through holes in the board 12, and the board contact portions 52, 64 and 74 are solder tail or pin contacts suitable for insertion into the holes where they are soldered in place by a known flow soldering process. Alternatively, other contacts such as surface mount foot contacts could be used and the conductive regions 94, 96 and 98 could be plated areas on the board surface to which the contacts are soldered by known surface mount soldering techniques.

FIGS. 7–11 illustrate an alternative embodiment of the invention in the form of an electrical connector 110. Similar reference characters used with connectors 10 and 110 identify similar structural features.

In connector 10, alternate cavity portions 28A and 28B contain ground terminals 48 or signal contacts 44 and 46. Thus, as seen in FIG. 2, the ground and signal current paths alternate and each signal terminal pair 44, 46 is sandwiched between a pair of ground terminals 48. In the connector 110 (FIG. 9), two adjacent cavity portions 28A or 28B receive signal terminal pairs 44, 46, and the pair of signal terminal cavities is sandwiched between cavities 28A or 28B containing ground terminals. The coupling of signal terminals to ground is not as effective as with the arrangement of connector 10, but the signal capacity or circuit density is increased. Every pair of signal terminals 44 and 46 is immediately adjacent to a ground terminal 48 and effective coupling to ground is achieved for every signal path.

Figure 11:
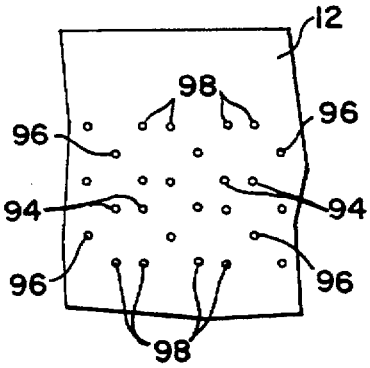
FIG. 11 is a fragmentary enlarged plan view of part of a motherboard used with the connector of FIG. 7.
Figure 10:
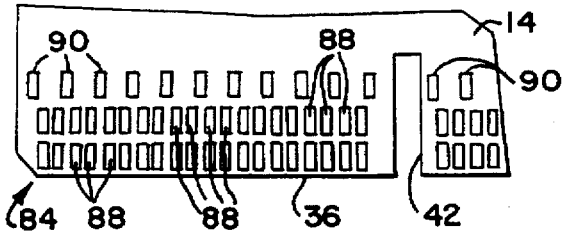
FIG. 10 is a fragmentary enlarged elevational view of part of a daughtercard used with the connector of FIG. 7.

The pattern of board contact portions 52, 64 and 74 of connector 110 differs from that of the connector 10. Thus, as seen in FIG. 11, the pattern of conductive regions or plated through holes 94, 96 and 98 in the motherboard 10 is altered. In addition, due to the differences in the way the terminals are arrayed, the arrangement of signal contact pads 86 and 88 and of ground contact pads 90 on the daughtercard 12 is also altered.

Figure 7:
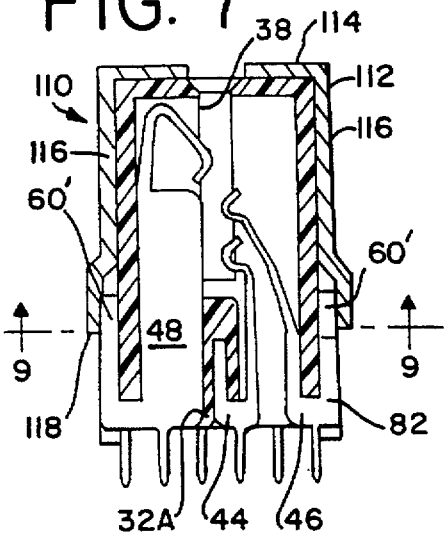
FIG. 7 is a view like FIG. 3 illustrating another embodiment of the invention, and is a sectional view taken along the line 7—7 of FIG. 9.
Figure 8:
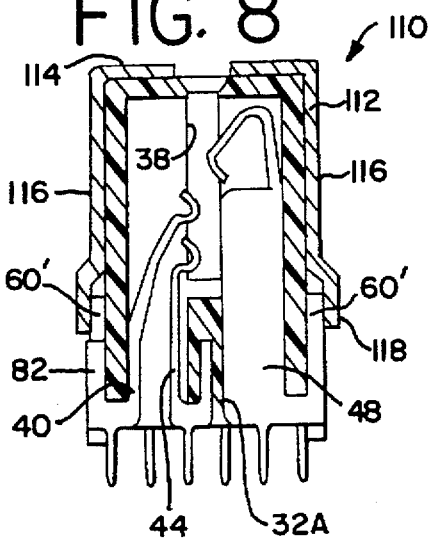
FIG. 8 is a sectional view of the connector of FIG. 7, taken along the line 8—8 of FIG. 9.
Figure 9:
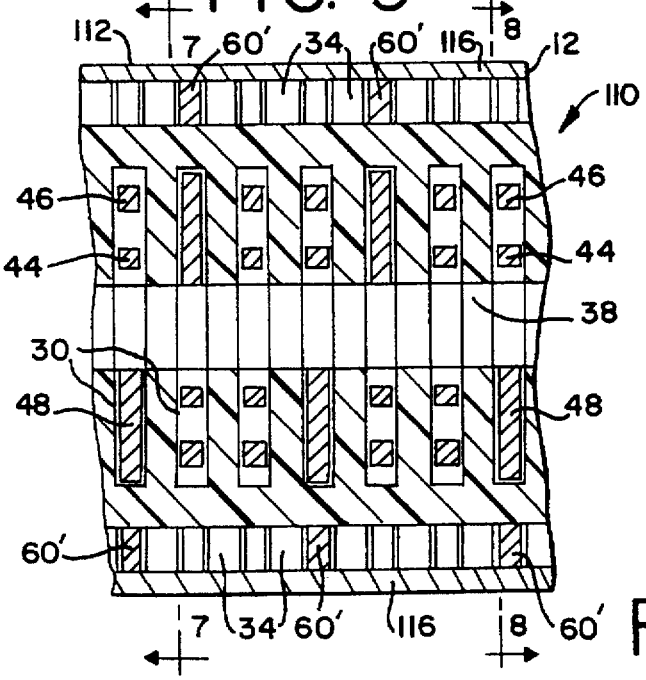
FIG. 9 is an enlarged fragmentary horizontal sectional view of the connector taken along the line 9—9 of FIG. 7.

As best seen in FIGS. 7 and 8, the ground terminals 48 of the connector 110 have mounting portions or arms 60' that are longer than the portions or arms 82 of the signal terminals 46. Arms 60' extend toward the top wall 18 beyond the arms 82 and beyond the spacers 34. Connector 110 includes a conductive metal shield 112 having a top wall 114 and side walls 116 terminating in an enlarged skirt 118. The skirt 118 engages the ends of the arms 60' so that the shield is electrically connected to ground through numerous electrically parallel paths providing extremely low resistance and inductive impedance.

An alternative configuration for retaining the terminals in the housing is shown in FIGS. 7 and 8. The housing is slightly modified and is particularly useful for applications in which the terminals are loaded into the cavity portions 28A, 28B by hand rather than with automation equipment. Rail 32 of the connector 110 has downwardly extending portions 32A located at each cavity portion 28A or 28B where a ground terminal 48 is mounted. These portion block access of the mounting portions 70 of terminals 44 to the aperture in the mounting rail 32. The resulting keying effect prevents inadvertent mounting of signal terminals in a cavity portion intended for a ground terminal 48.

While the present invention has been described with reference to the details of the embodiments of the invention shown in the drawing, these details are not intended to limit the scope of the invention as claimed in the appended claims.

We claim:

1. An electrical connector for electrically connecting to a circuit device having signal and ground contact regions, said electrical connector comprising in combination:

an insulating housing including top and bottom walls and a side wall;

a plurality of cavities in said housing;

a receptacle in said top wall for receiving the signal and ground contact regions of the circuit device;

a plurality of signal terminals in some of said cavities and a plurality of ground terminals in others of said cavities;

each said signal and ground terminal including a mounting portion engageable with said housing for holding said terminal in said housing and including a contact portion for engaging one of said signal and ground contact regions upon insertion of the circuit device into said receptacle; and an electrically conductive shield covering at least portions of said top and side walls;

said electrical connector being characterized by:

said mounting portions of said ground terminals extending to the exterior of said side wall into engagement with said shield.

2. An electrical connector as claimed in claim 1, said mounting portions of said signal and ground terminals both extending to the exterior of said side wall from the bottom wall toward the top wall of said housing; and the mounting portions of said ground terminals being longer than the mounting portions of said signal terminals, the mounting portions of said signal terminals being spaced from said shield.

3. An electrical connector as claimed in claim 2, said housing including spacers projecting from said side wall between said mounting portions of said signal and ground terminals.

* * * * *